US005634503A

United States Patent [19]

Musil et al.

[11] Patent Number: 5,634,503

[45] Date of Patent: Jun. 3, 1997

[54] AUTOMATED REFUELLING SYSTEM

[75] Inventors: David I. Musil, Port Coquitlam; George N. P. Root; Joseph A. Padula, both of Vancouver; Owen R. Williams, New Westminster, all of Canada; William D. Ramsey, Jr., Kingwood, Tex.

[73] Assignee: Shell Oil Company, Houston, Tex.

[21] Appl. No.: 461,276

[22] Filed: Jun. 5, 1995

[51] Int. Cl.[6] ..... B67D 5/00

[52] U.S. Cl. ..... 141/232; 141/279; 141/388; 137/234.6; 137/615; 901/6; 901/16; 901/41

[58] Field of Search ..... 141/231, 232, 141/98, 279, 387, 388; 137/234.6, 615; 901/6, 16, 41

[56] References Cited

U.S. PATENT DOCUMENTS

| | | | |
|---|---|---|---|
| 2,326,415 | 8/1943 | Titus | 141/279 |
| 2,979,087 | 4/1961 | Vogt | 141/232 X |
| 3,527,268 | 9/1970 | Ginsburgh | 141/98 |
| 3,642,036 | 2/1972 | Ginsburgh et al. | 141/94 |
| 3,664,386 | 5/1972 | Wenzel | 141/231 X |
| 3,888,362 | 6/1975 | Fletcher et al. | 901/16 X |
| 3,901,392 | 8/1975 | Streckert | 901/16 X |
| 4,673,075 | 6/1987 | Ueyama et al. | 901/6 X |
| 4,781,517 | 11/1988 | Pearce et al. | 901/16 X |
| 4,881,581 | 11/1989 | Hollerback | 141/113 |
| 5,183,377 | 2/1993 | Becker et al. | 414/751 |
| 5,238,034 | 8/1993 | Corfitsen | 141/94 |
| 5,383,500 | 1/1995 | Dwars et al. | 141/98 |
| 5,404,923 | 4/1995 | Yamamoto et al. | 141/279 |
| 5,445,282 | 8/1995 | Erikkilä | 212/312 |

FOREIGN PATENT DOCUMENTS

| | | |
|---|---|---|
| 418744A2 | 3/1991 | European Pat. Off. . |
| 4242243A1 | 6/1994 | Germany . |
| WO94/03391 | 2/1994 | WIPO . |
| WO95/32919 | 12/1995 | WIPO . |

OTHER PUBLICATIONS

*Technology*, "Pumping Gas in the Year 2000," by Klaus–Ulrich Blumenstock and Konstantin Tschovikov, 3 pp. Dec. 1995.

Serapid chain sales literature, Serapid, France, 2 pages. Jan. 1995.

"Lawrence Livermore Laboratory: Hoping to Make Highways Safer;" *Technology Transfer Business*, Fall 1994, 1 page.

Dawn Stover, "Radar on a Chip, 101 Uses in Your Life" *Popular Science*, Mar. 1995, 6 pages.

Cheryl Ajluni, "Low–Cost Wideband Spread–Spectrum Device Promises to Revolutionize Radar Proximity Sensors," *Electronic Design*, Jul. 25, 1994, 2 pages.

*Primary Examiner*—J. Casimer Jacyna
*Attorney, Agent, or Firm*—Del S. Christensen

[57] ABSTRACT

A refuelling system is provided, the system comprising: a plurality of vertically telescoping elements, the telescoping elements containing a constant length of flexible conduit for transfer of fuel; at least one vertically movable pulley to maintain a constant length of flexible hose within the telescoping elements; an overhead gantry capable of moving the vertically telescoping elements in two horizontal essentially perpendicular axes; and a rotating lower portion of the telescoping elements capable of rotating about an essentially vertical axis and supporting a fuel nozzle. The refuelling system of the present invention does not result in significant segments of unsupported lengths of conduits for fuel, compressed air, vapor recovery, electrical power or control or sensor signals. It is relatively simple and utilizes readily available components and parts, and does not required significant machining of components. This results in an installation that is economical to install and operate.

19 Claims, 7 Drawing Sheets

AUTOMATED REFUELLING SYSTEM

FIELD OF INVENTION

This invention relates to an apparatus for automated refuelling of vehicles.

BACKGROUND TO THE INVENTION

Numerous apparatuses have been proposed for automatic refuelling of vehicles, but none have been commercially applied to retail gasoline outlets because of the expense and complexity of the systems. To be economically competitive with customer's or attendant's ability to refuel automobiles manually, such an automated refuelling system must be relatively simple. It must therefore be assembled from relatively inexpensive components. Additionally, minimal modifications to the vehicles to be refuelled is necessary.

U.S. Pat. No. 3,527,268 suggests a automated refuelling system that includes a movable head having three functional arms, an arm to open a gas cap cover lid, an arm to remove a gas cap, and a fuel fill nozzle that is inserted into the fuel inlet. The movable head is located near the fuel inlet of a vehicle by a gantry that positions the movable head in a horizontal two-dimension plane over an appropriate position. A vertical arm supporting the movable head then extends downward from the gantry to position the movable head at an appropriate elevation. Fuel hoses and power and control cables and conduits are strung from the top of the vertical arm to a central originating point. These cables and conduits must therefore be self-supporting for a long span, and considerable clearance must be allowed for the cables and conduits to hang when the movable head is located near the central originating point. These long and unsupported fuel lines would move due to inertial changes when flow starts and stops. Having these lines move like this in view of a customer would be undesirable. A canopy over the apparatus must also be a massive structure because of clearance required to raise the vertical am upward. Such massive structures are not only relatively expensive, but are intimidating and unappealing to customers. Furthermore, such a structure could not be provided within existing gasoline station canopies, and removal and replacement of these canopies therefore is a necessary part of retrofitting automated refuelling equipment into existing service stations.

EPO Patent Publication No. 0 418 744 A2 suggests a robot that is mounted on a track adjacent to a stall in which a vehicle to be refuelled can be parked. In the apparatus of Publication '744, the robot picks up a selected refuelling nozzle and inserts the nozzle into a specially provided insert in the vehicle's fuel inlet. Besides for the fuel inlet insert, modification of the vehicle is required to enable a driver to open and close the fuel inlet cover lid from the inside of the vehicle. Locating the automated refuelling robot on the ground minimizes the structure required to support the robot, but makes it very difficult for the robot to reach fuel inlets on a wide variety of vehicles. Automobiles are built with fuel inlets on the right, left, or rear of the vehicles. Accessing each of these locations relative to a vehicle parked in a refuelling spot with a ground mounted refuelling robot would be difficult. Further, customers are leery of a robot that would have to reach over their vehicle to access a fuel inlet. Ground mounted robots are also more prone to be damaged by poorly driven vehicles or vandals than a robot that is mounted over-head.

German Patent Application 42 42 243 A1, PCT Patent Application No. IT93/00017, and U.S. Pat. Nos. 3,642,036 and 5,238,034 also suggest ground-mounted refuelling robots that could not reach fuel inlets for vehicles with fuel inlets in the rear or the side opposite to the position of the robot.

It is therefore an object of the present invention to provide an apparatus for automated refuelling of vehicles that is relatively simple and inexpensive, and wherein a refuelling nozzle is suspended from an overhead gentry. It is a further object to provide such an apparatus wherein significant lengths of unsupported segments of conduits are not required.

SUMMARY OF THE INVENTION

The objectives of the present invention are accomplished by providing a refuelling system comprising: a plurality of vertically telescoping elements, the telescoping elements containing a constant length of flexible conduit for transfer of fuel; at least one vertically movable pulley to maintain a constant length of flexible hose within the telescoping elements; an overhead gantry capable of moving the vertically telescoping elements in two horizontal essentially perpendicular axes; and a rotating lower portion of the telescoping elements capable of rotating about an essentially vertical axis and supporting a fuel nozzle. In a preferred embodiment, flexible conduits for fuel supply, pressurized air, electrical power and/or control signals kept aligned within flexible tracks along both horizontal axes of movement of the gantry so than no significant segment of conduit within the refuelling apparatus is unsupported. The lowermost portion of the telescoping elements is rotatable about the vertical axis so that the apparatus can be aligned with either side, or the rear of a vehicle to be refuelled. The rotation is therefore around at least a 180° arc. This apparatus is capable of positioning a refuelling nozzle adjacent to a vehicle's fuel inlet from a vertically extendable arm that is sufficiently compact that the support gantry can be installed under a typical existing service station canopy.

In a preferred embodiment, the telescoping elements comprise three elements with the top element fixed, the middle element fixed to the movable pulley, and moved by a vertical screw and the bottom element moved by a rigid chain that is fixed to the top element at one end of the rigid chain and fixed to the lowermost element at the other end of the rigid chain, and passing through the inside of the middle element.

DETAILED DESCRIPTION OF THE INVENTION

Figure 1:
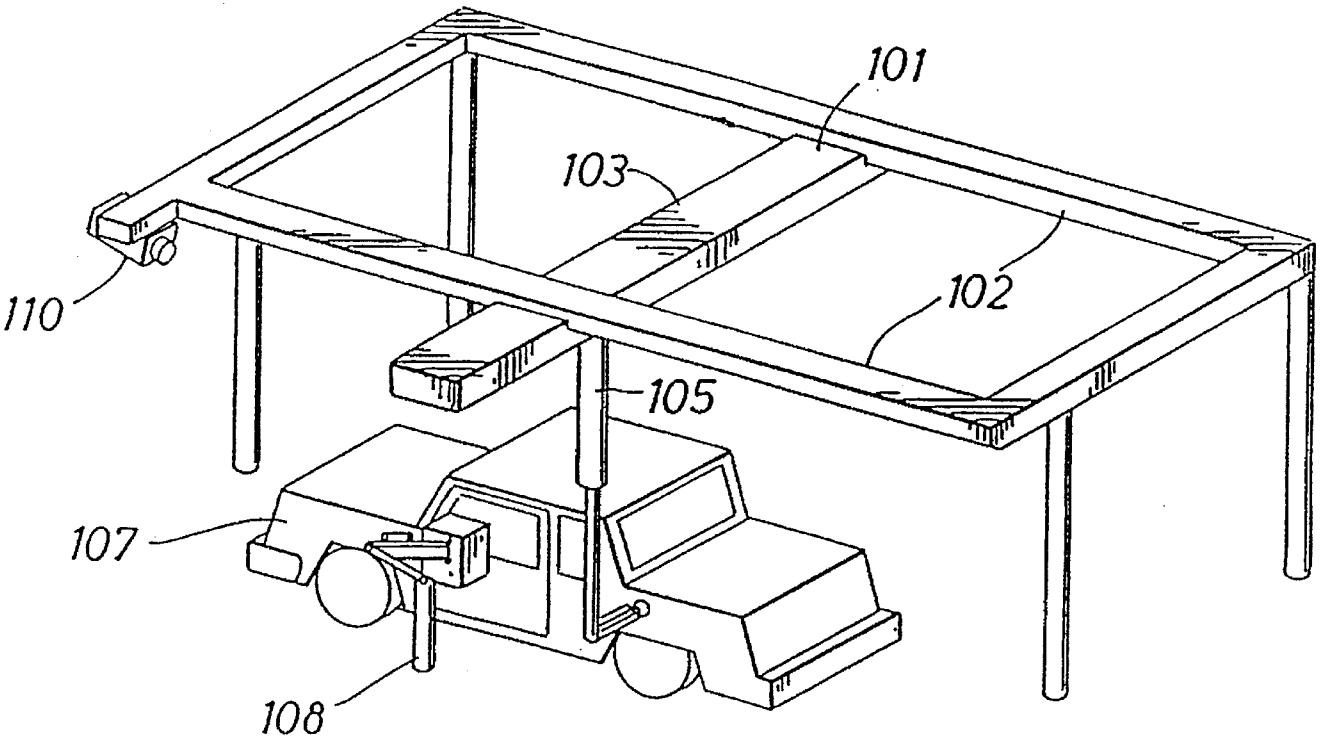
FIG. 1 shows a perspective view of the general arrangement of a preferred refuelling system of the present invention.

Referring now to FIG. 1, the general arrangement of components of a vehicle refuelling system according to a preferred embodiment of the present invention is shown. An overhead gantry 101 with a set of longitudinal supports 102 and a cross member 103 is shown. This gantry can move a nozzle manipulator 105 to position the refuelling nozzle on either side, or the rear of a vehicle, according to the location of the fuel inlet.

The location of the fuel inlet can be determined from data obtained from a transponder card (not shown) preferably placed on a windshield of a vehicle to be refueled 107. The transponder card can be one of many commercially available, preferably passive, transponder systems. For example, Amtech, located in Dallas, Tex., offers a transponder card system called "INTELLA TAG" which cards sell for about twenty five U.S. dollars. This transponder card system has a data capacity of 1408 bits, and operate on a radio frequency of 924 Mhz. Motorola Indala, of San Jose, Calif., produces another passive RF transponder system. Motorola's system has a 64 bit capacity that is readable from about two feet. Cards cost about three U.S. dollars, and acceptable readers can be purchased for about 630 U.S. dollars. TIRIS, of Austin, Tex., also offers acceptable systems. Active transponders are also available that operate on watch-type batteries and have significantly greater range. Although active transponders are more expensive, they could be acceptable in the practice of the present invention.

Other means of determining the vehicle type and/or identification could be utilized other than a transponder. For example, an optical bar code could be provided on a sticker on a window, bumper or fender. Magnetic strips could also be provided to transmit this information.

The transponder system of the present invention provides vehicle information to the automated refuelling system thereby allowing the system to know the location of the fuel inlet on the vehicle. Credit card information could also be transmitted automatically, but alternatively, a customer interface 108 including a credit card reader (not shown) may be included. The use of the customer interface and credit card reader ensures that the refuelling operation is intentionally initiated by the customer and provides a confirmation that the authorized customer is receiving the refuelling service.

The positioning of the fuel supply nozzle adjacent to the fuel inlet is preferably accomplished by a position sensor located on the fuel supply nozzle. The position sensor determines the position of the fuel supply nozzle with relationship to the fuel supply inlet. This position sensor may be, for example, a magnetic flux determination, with a magnet located on either the fuel inlet, fuel cap or on the hinged lid over the fuel inlet, or a vision system with a visual pick-up located on the fuel supply nozzle with information from the visual pick-up processed by software capable of recognizing the outline of the fuel hinged cover or fuel cap, and most preferably, also the position of the hinged cover about its hinged axis.

If a vision system is utilized to identify the position of the fuel inlet, the vision system may also be used to identify the location of the fuel cap after the hinged cover is opened, and possibly to identify the license plate number of the vehicle, for example, as a security check.

The customer interface is preferably automatically movable in the vertical direction and laterally toward the vehicle so that the interface is easily accessible from the driver's side window without the driver having to open the vehicle door. Movement of the customer interface could be initiated by the automated refuelling system upon a vehicle coming to a stop in a position to be refuelled, and preferably, after a confirmation that the engine of the vehicle has been shutdown. Information obtained from the transponder system could dictate the best vertical height for the customer interface for the particular vehicle. The automated refuelling system also is preferably provided with a means to determine the location of the vehicle relative to the system, and this information can be used to determine the extent of movement toward the vehicle for best placement of the customer interface. The customer interface, in a preferred embodiment, does not move laterally along the axis of the vehicle because the driver is encouraged to pull up to the interface with the interface juxtapose to the driver's side window. This provides that the vehicle will be within reach of the automated refuelling system.

A preferred method and apparatus to determine if the vehicle's engine is operating is disclosed in U.S. patent application Ser. No. 08/461,279, incorporated herein by reference.

A preferred customer interface is disclosed in U.S. patent application Ser. No. 08/461,275, incorporated herein by reference.

A simple ultrasonic range determination can alternatively be provided to determine the location of the vehicle relative to the customer interface. A preferred ultrasonic range finding system is available from Polaroid and cost only about fourteen U.S. dollars each. Preferably, an acoustic system is provided to confirm that movement of the customer interface will not cause a collision with the vehicle.

Range finding sensors of the present invention could be, rather than ultrasonic, for example, radar or laser. Ultrasonic systems are presently preferred because they have acceptable sensitivity and are less expensive than currently available alternatives. An acceptable radar based range finding sensor has been recently developed by Lawrence Livermore Laboratories, and has been referred to as a micropower impulse radar, or MIR. This technology has been incorporated in commercial products and is both inexpensive and accurate.

The means to determine the position of the vehicle relative to the automated refuelling system may be, for example, a probe extended to an expected location of a tire, a series of pressure sensors under or in the surface on which the vehicle is located, a series of ultrasonic, radar, laser ranger finders or a vision system. The vision system is shown with a camera 110 positioned above the expected location of the vehicle looking down at the vehicle. The camera produces an image that is captured and reduced to a digital format by a frame grabbing image processing card, and communicated to a central processing unit (not shown). The central processing unit may be located in a convenient location, for example either in a building at the location of the automated refuelling system, or remotely. The vision system can determine from the data provided by the camera the location of the vehicle within the view of the camera. A vision system could also verify that the shape and, if a color camera is utilized, if the color of the vehicle matches the vehicle for which the transponder card is issued.

Automated refuelling will require that measures be taken to prevent overfilling of fuel tanks by the automated refuelling systems. Use of the fuel shut-off mechanism disclosed in U.S. patent application Ser. No. 08/461,281, incorporated herein by reference is preferred.

Figure 2A:
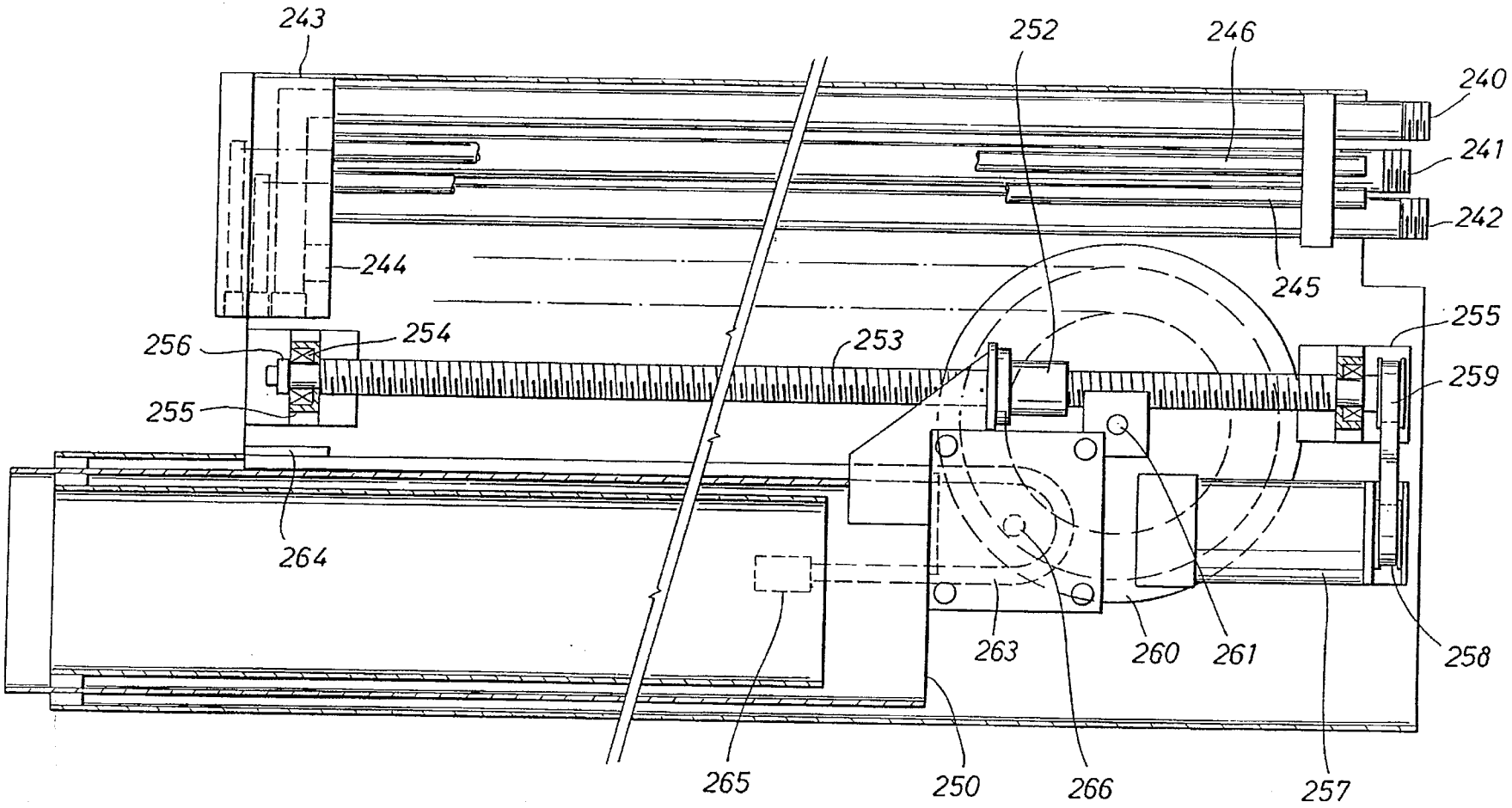
FIG. 2A and FIG. 2B show partial cross sections of a profile and top views, respectively, of a preferred embodiment of an upper telescoping unit useful in the present invention.
Figure 2B:
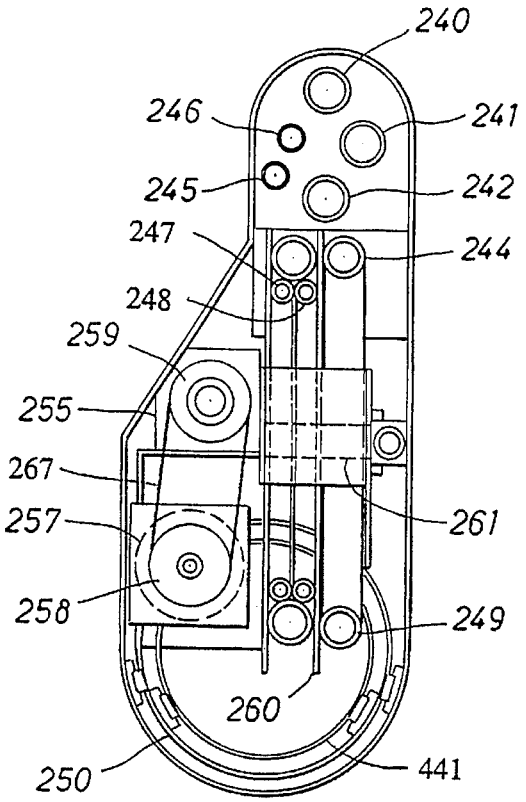

Referring now to FIG. 2A and FIG. 2B, a profile view and a top view, respectively, of an upper section of a telescoping element of the apparatus according to the present invention is shown. Three fuel conduits are provided 240, 241, and 242 within an uppermost telescoping element 251. The fuel conduits provide separate paths for different types of fuel to a manifold 243 at the lower section of the upper telescoping element. Paths for the three different fuels are combined within the manifold, and one flexible fuel hose exits the manifold at a port for a flexible fuel conduit 244. The three types of fuel can be different octane gasolines, and mixing of different octanes of gasoline within a limited length of hose is considered permissible. The volume of combined fuel from the manifold through the fuel nozzle can be kept to within this limited amount. A conduit for vapor recovery 245 and a conduit for compressed air supply 246 are also provided, with separate outlets from the manifold for each 247 and 248 respectively. A single combined fuel conduit at the manifold 249 is provided. The manifold also preferably includes a low-point plug which can be removed to drain fuel from the fuel conduit and manifold.

A middle telescoping middle element 250 is provided that can be drawn into the uppermost telescoping element 251. The telescoping middle section is provided with a ball nut 252 fixed to the top that allows the position of the telescoping middle element to be controlled by a threaded shaft 253. The threaded shaft is mounted by roller bearings 254 supported on pillow blocks 255. The roller bearings are kept in place by lock washers 256. Tapered could roller bearings support the weight of the threaded shaft, and vertical forces placed on the shaft. Alternatively, lower cost non-tapered bearings could be used. The threaded shaft is rotated by a motor 257 driving a pulley 258, which drives a pulley connected onto the threaded shaft 259 by a belt 267.

A pulley 260 is fixed to the upper portion of the middle telescoping section 250 to guide conduits and allow for orderly storage of the conduits as the telescoping sections are extended and retracted. The pulley 260 is mounted on a shaft 261 that is fixed to the middle telescoping section at a fixed end, and slidably connected to a guide at the other end. Conduits for fuel, vapor recovery, compressed air, and electrical and control cables pass from the lower portion of the uppermost telescoping element over the pulley 260 and into the inside of the other telescoping elements. Therefore when the middle telescoping section is lowered by one unit of length, the pulley lowers by one unit of length, and the length of conduit within the inside of the two lower telescoping elements increases by the same unit of length, and a fuel nozzle attached to the telescoping unit lowers by two unit lengths. The length of conduits with the three elements therefore remains constant as the nozzle is raised or lowered. Conduits are therefore internal to the elements, and do not have to be feed in or pulled out from the apparatus. This eliminates some wear on the conduits as the fuel nozzle is raised and lowered.

The position of the lowermost telescoping element is controlled by a rigid chain 263. The rigid chain is fixed to the upper telescoping element by a bracket 264 and to the lower telescoping element 441 by a lower end bracket 265. A guide box for the rigid chain 266 is provided at the top of the middle telescoping section. The guide box forces the rigid chain to reverse direction, or turn by essentially 180° and extend downward into the middle telescoping section. By maintaining a constant length, the rigid chain moves the lower telescoping section up and down as the middle telescoping section is moved by rotation of the threaded shaft 253. A rigid chain is a link chain such as that available from Serapid, France, which can support a significant load in compression, and yet turn around a sprocket like a normal link chain.

Figure 3:
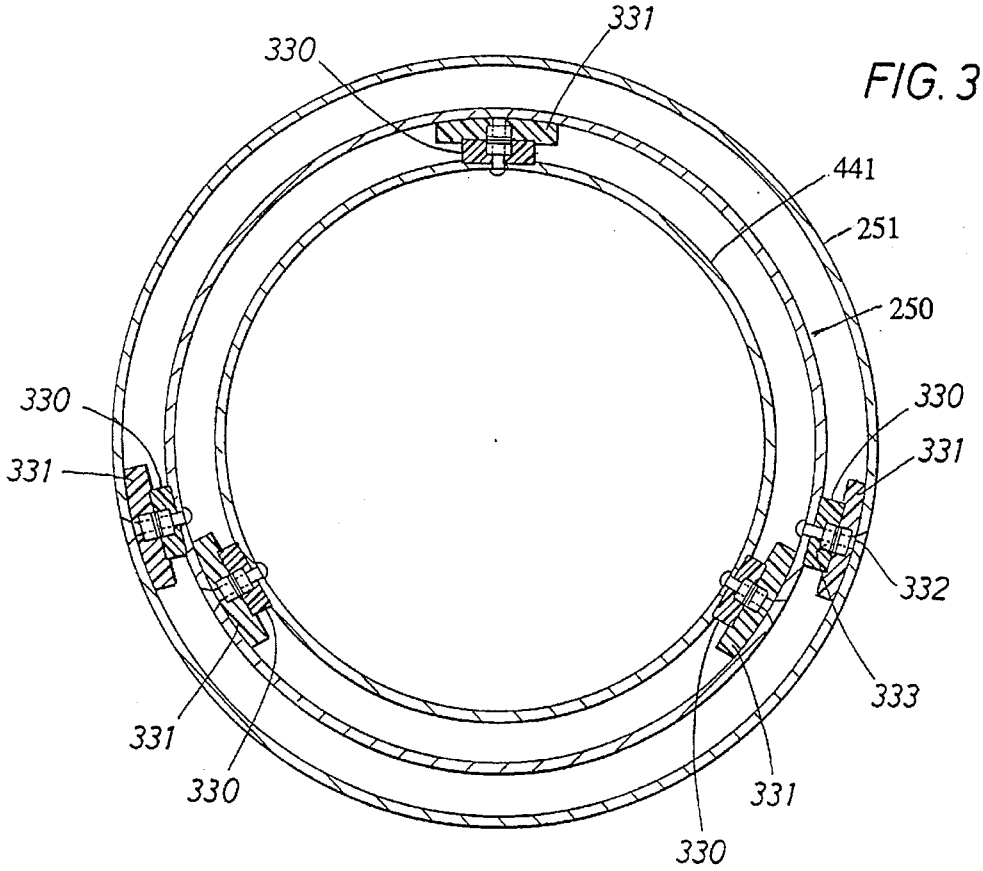
FIG. 3 is a cross sectional view showing guides for the telescoping elements.

Referring now to FIG. 3 along with FIGS. 2A and 25, sliding bearings for the alignment of the telescoping elements are shown. Vertical outside strips of a plastic 330 are attached to the outside of the middle and lowermost telescoping sections, and notched vertical plastic strips 331 with notches machined to match the outside strips are attached to the inside of the uppermost two telescoping elements. The plastic strips are preferably fabricated from different plastic materials to minimize friction between the two, and fabricated from hard-self lubricating plastics such as nylon blends. The strips are attached to the telescoping element by machine screws 332 and nuts 333. These alignment strips permit the telescoping elements to be fabricated from relatively inexpensive extruded aluminum tubes without machining of the tubes. Acceptable and low cost alternatives to the plastic strips may be readily available cabinet drawer bearings.

Figure 4A:
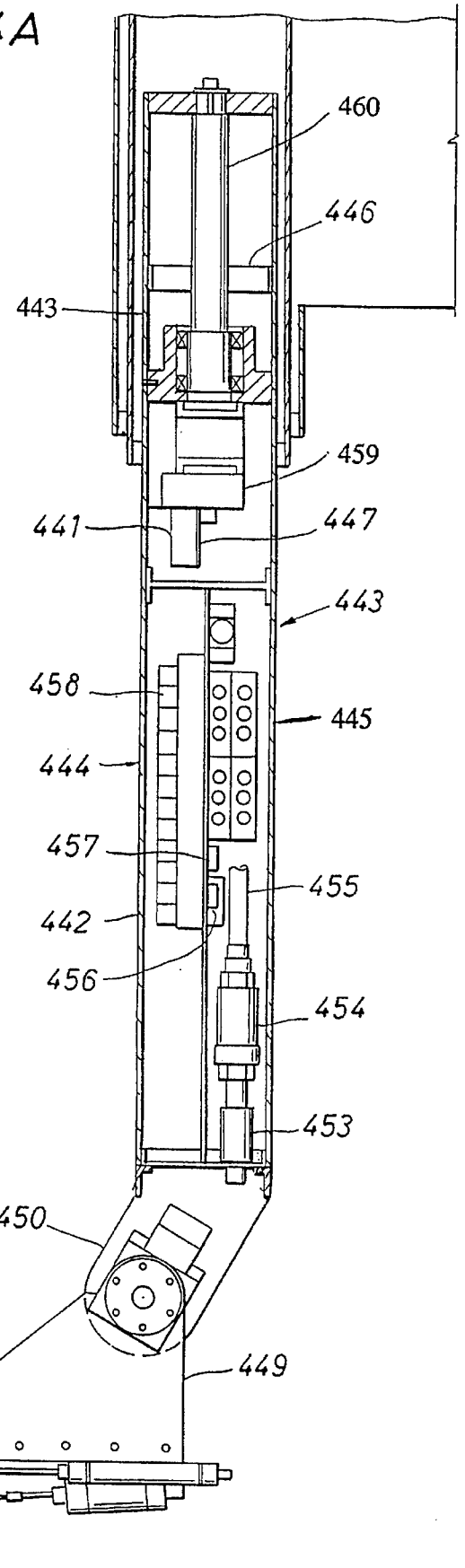
FIGS. 4A and 4B show different profile cross sectional views of the lowermost telescoping element of an apparatus according to a preferred embodiment of the present invention.
Figure 4B:
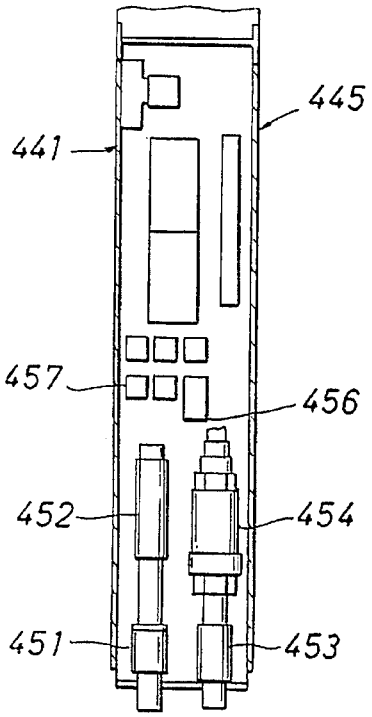

Referring now to FIGS. 4A and 45 a lowermost telescoping element 441 is shown. This element has a rotating segment 442, and a nonrotating segment 443. The rotating segment is divided into a purged side 444, and a nonpurged side 445 shown in FIG. 45. Electrical motor 447 provides rotation of the rotating segment through gears 459 and shaft 460. The fuel conduit and other conduits that extend down to the rotating element 442 from the top of the movable pulley 260 and through guides 446 within the nonrotating segment of the lowermost rotating element. The length and flexibility of these conduits permit the rotating element to turn by at least 135° in each direction and still maintain the conduits within the telescoping elements in an orderly fashion. The fuel conduit and vapor recovery conduit pass through the nonpurged side (not shown), and the purged side contains any electrical switches, valves and relays required for operation of the refuelling nozzle that do require a non-explosive environment. The non-purged section may contain, for example: a vacuum pump 451 for supplying suction pressure to the end-effector, with a muffler 452 to permit quiet operation of the vacuum pump; a fuel line venturi 453 for use with a fuel cut-off switch; a positive cut-off fuel valve 454 connected to a fuel supply conduit 455 (shown in dotted lines); a pressure sensor 456 for determining the pressure in a vapor recovery line; and pressure switches 457 for various functions of the end-effector.

Control signals to and from the lower telescoping unit are preferably multiplexed so that few wires, or optical cables, can transfer signals to and from the lower telescoping unit to a central processing unit for control of the automated refuelling system. Additional expense of equipment required for multiplexing will be offset by a considerable savings in the cost of a wiring harness. Further, maintenance of the wiring harness and troubleshooting of any failures of the wiring harness would be a significant expense, whereas the components of the multiplexing can be more readily accessible for troubleshooting and repair. Further, because so few wires or optical cables are required, spares could be provided with an initial fabrication at nominal additional expense.

An end-effector 448 optionally having arms that are capable of opening a hinged fuel inlet cover 201, removing a fuel cap 202, or insertion of a fuel nozzle into a vehicle's fuel inlet 203 is attached to the lower extremity of the lowermost telescoping element. The end-effector is mounted on a rotating bracket 449 that is pivotably mounted to a fixed bracket 450 attached to the telescoping element 441. The purged side of the lowermost telescoping element contains electrical switches, relays, and electrically operated pneumatic valves that are advantageously kept in an atmosphere that does not contain an explosive mixture. The purged portion is kept free of explosive mixtures by supplying a sufficient volume of compressed air to maintain a positive pressure within the purged section. Fuel vapors will therefore be prevented from penetration into the purged section. Providing this purged section in the lowermost telescoping element provides for significant advantages. The pneumatic air lines from the valves are of a minimal length, providing for fast action of the pneumatic actuators which are controlled by switches. The number of flexible conduits that must be moved by the gantry to the vicinity of a vehicle's fuel inlet is also minimized, resulting in a simplified, reliable, and less bulky apparatus. For example, only three conduits, and electrical conduits, must be managed within the system above the purged section, and twisted within the telescoping units to accommodate rotation of the end effector to enable the end effector to approach a vehicle from different sides.

Pitch movement of the end-effector could also be provided by a motor, preferably a pneumatic motor, rotating the end-effector about pivot axis 534.

Figure 5:
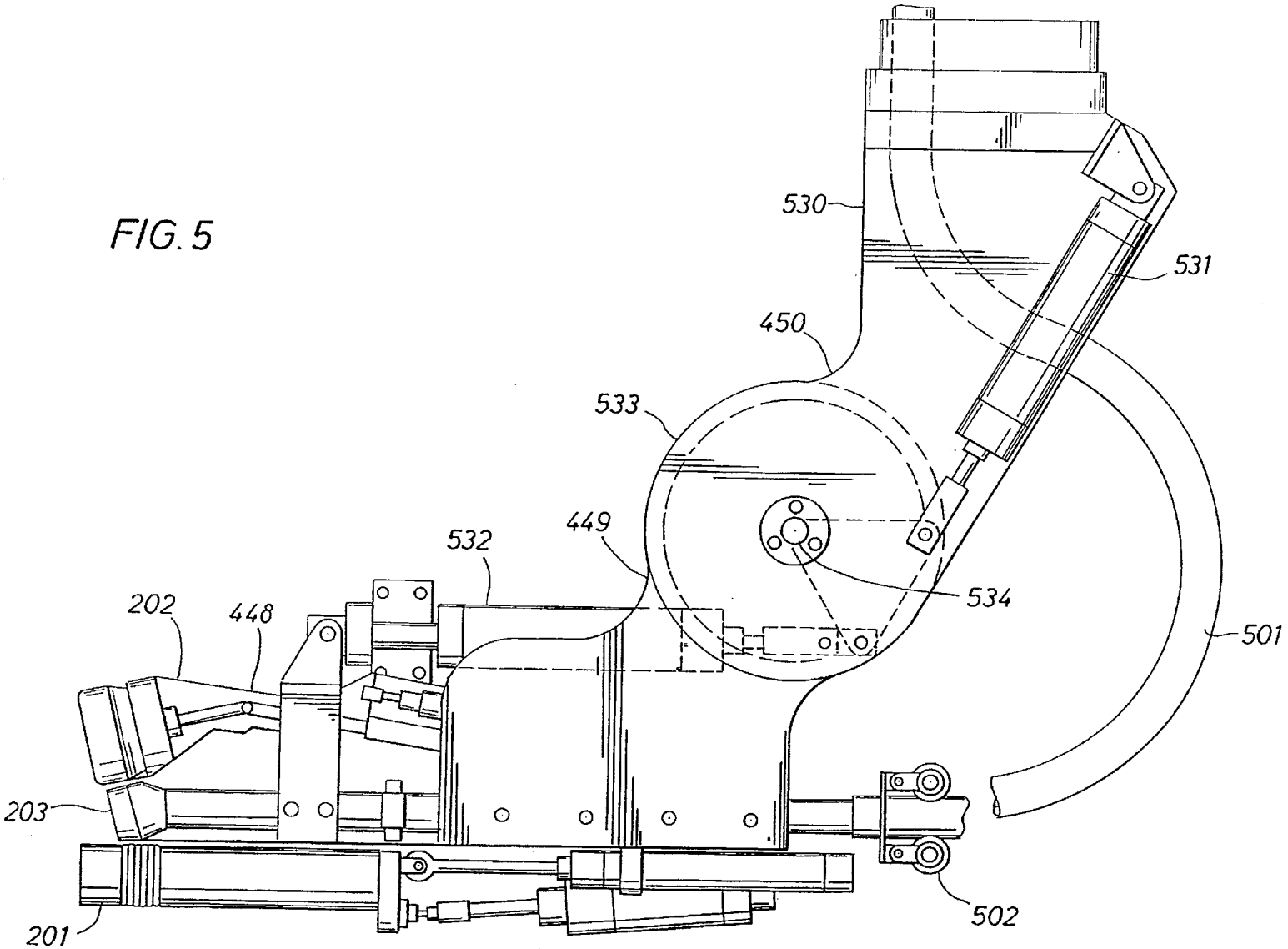
FIG. 5 shows a profile view of a bracket for supporting a refuelling nozzle from the lowermost telescoping element of an apparatus according to a preferred embodiment of the present invention.

Referring now to FIG. 5 a end-effector positioner is shown. The end-effector positioner 530 has a first pneumatic cylinder 531 and a second pneumatic cylinder to provide for rotation of the end-effector about a pivot axle 534. A circular bearing plate 533 may be provided made of a self-lubricating plastic such as a nylon blend to provided for both alignment and low-friction rotation of the end-effector. The pneumatic cylinders both rotate the moving bracket 449 in relationship to the fixed bracket 450, thus varying the angle of the end-effector from vertical. Two pneumatic cylinders such as shown in FIG. 5 permit about 150 degrees of rotation. The range of rotational movement of the end-effector preferably is from about vertical up to about vertical down, thus permitting refuelling of vehicles having fuel inlets facing upward, and also permitting stowing the fuel nozzle in an upward position. For this range of movement about a single pivot point, a plurality of cylinders is needed, and a plurality of pneumatic cylinders are therefore preferred. Movement to an essentially vertical position is preferred for storage and movement of the end-effector.

A flexible fuel conduit 501 extends from the lowermost telescoping element to the end-effector arm for insertion of a fuel nozzle into a vehicle's fuel inlet 203. Rollers 502 are provided in a preferred embodiment of the present invention to move the flexible fuel conduit 501 into and out of the arm 203 resulting in a compact and relatively simple apparatus to insert a fuel nozzle into a vehicle.

Figure 6A:
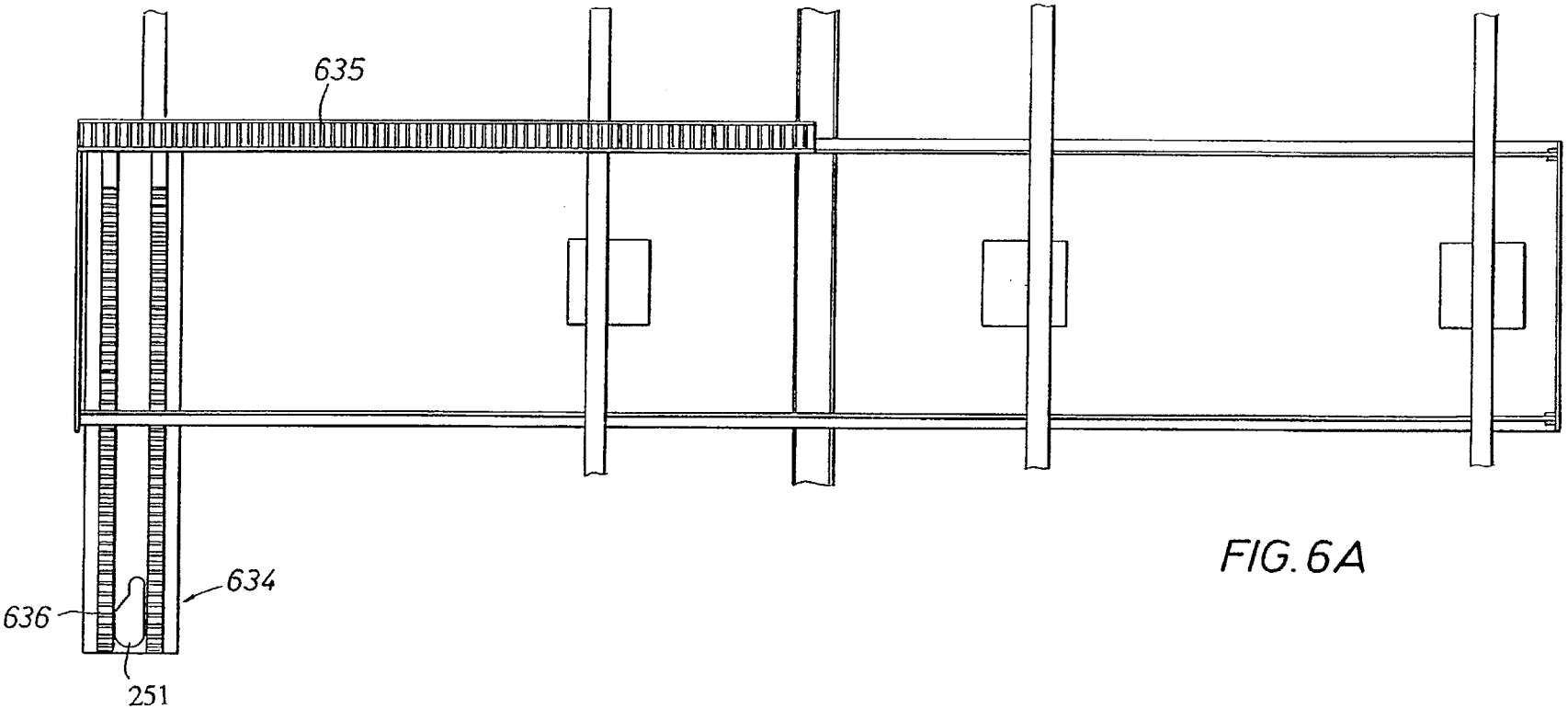
FIGS. 6A, 6B, and 6C show, respectively, top, end and side sectional views of a gantry according to an embodiment of the present invention.
Figure 6B:
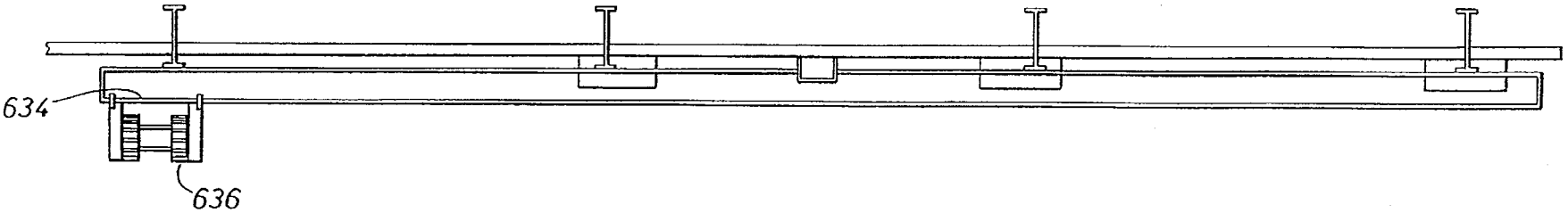
Figure 6C:
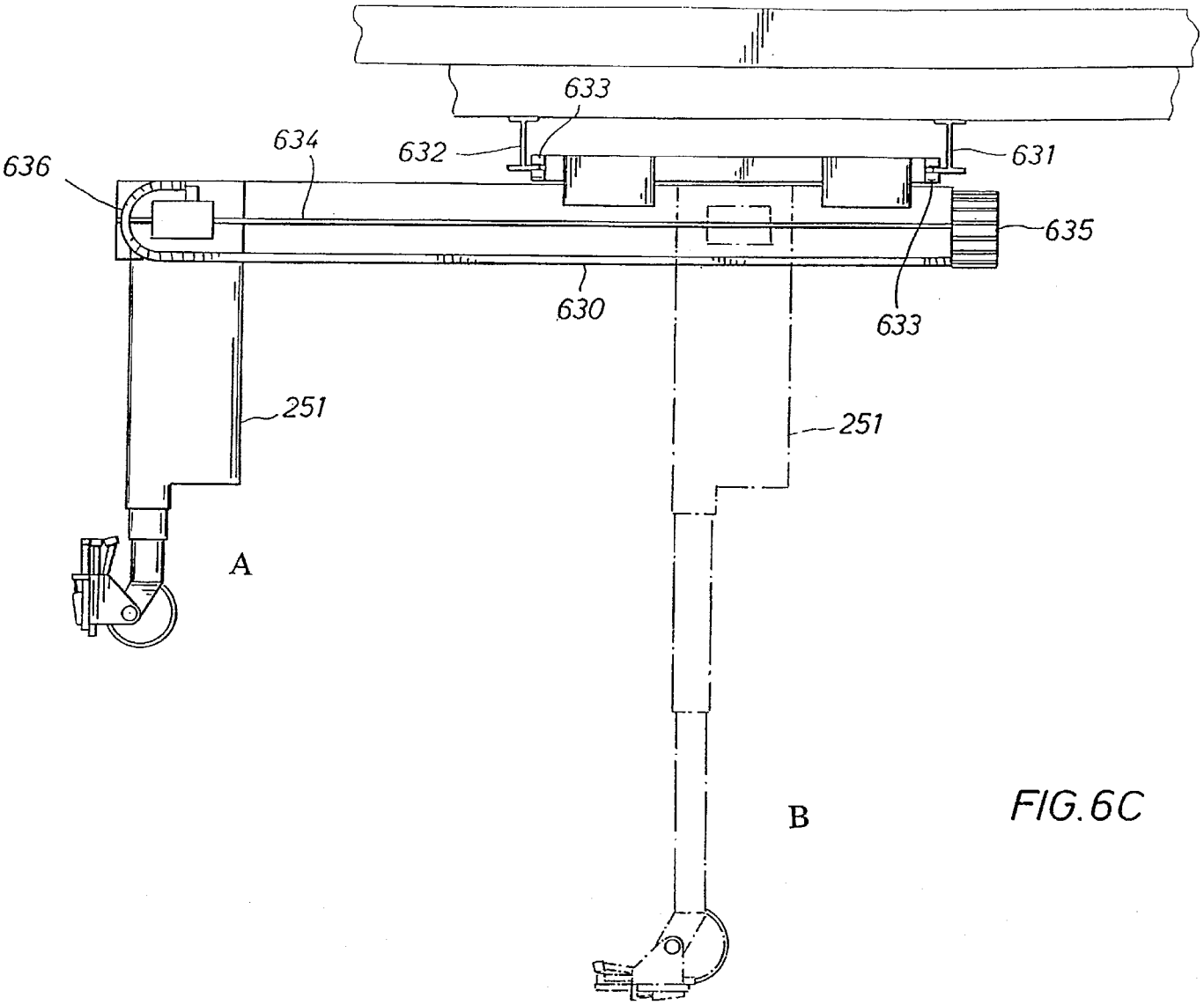

Referring now to FIGS. 6A, 6B, and 6C, three views of an over head gantry for support and positioning of the upper telescoping element with relationship to a particular vehicle to be refuelled is are shown. A cross member 630 is suspended from two longitudinal rails 631 and 632. The crossmember 630 moves on rollers 633. A fixed motor moves the crossmember by a chain or belt 635, the chain or belt being fixed to the crossmember and rotating around sprockets located at limits of movement of the crossmember. The upper telescoping element 251 is suspended from the crossmember on a set of crossmember rails 634. The end-effector and telescoping elements are shown in a stowed position (Position A) and in a dotted outline in an extended position (Position B). The position of the upper telescoping element along the crossmember rails may be controlled by a crossmember position motor (not shown). The crossmember position motor being fixed and moving the upper telescoping element by a chain or belt, the chain or belt being attached to the upper telescoping element and rotating around sprockets located at the limits of movement of the upper telescoping element.

A crossmember flexible track 636 is preferably provided within the crossmember to support flexible conduits along the length of the crossmember.

A significant feature of a preferred embodiment of the present invention is the method of managing the required lengths of flexible conduits that must be provided to the telescoping elements. These flexible conduits are cradled within a flexible track that is positioned along one of the longitudinal rails, the flexible track being at least one half of the length of the longitudinal rail, so that the flexible track and the flexible conduits supported by the flexible tracks can reach each end of the longitudinal rails. The cables and conduits are therefore managed in a way that loose conduits are avoided.

The system for positioning a refuelling nozzle of the present invention can be located under many existing designs of canopies used in gasoline refuelling stations. These canopies will not require significant modification for upgrading to an automated refuelling system, resulting in a significant economic advantage over systems where canopy replacement is required. The crossmember can extend, as shown in FIG. 6A, beyond the sides of a longitudinal rail. This configuration can be advantageous when an existing canopy is retrofitted with a system according to the present invention because canopies are often only large enough to cover the vehicle. The telescoping elements therefore need to be placed outside of the boundaries of the preexisting canopy in access a fuel inlet on that side of the vehicle.

The refuelling system of the present invention does not result in significant segments of unsupported lengths of conduits for fuel, compressed air, vapor recovery, electrical power or control or sensor signals. It is relatively simple and utilizes readily available components and parts, and does not required significant machining of components. This results in an installation that is economical to install and operate.

A preferred end-effector for use with the refuelling system of the present invention is described in U.S. patent application Ser. No. 08/461,281, incorporated herein by reference.

The preceding description of the present invention is exemplary, and reference is made to the following claims to determine the full scope of the present invention.

We claim:

1. A refuelling system comprising:

a plurality of vertically telescoping elements, the telescoping elements containing a constant length of flexible conduit for transfer of fuel;

at least one vertically movable pulley to maintain a constant length of flexible hose within the telescoping elements;

an overhead gantry capable of moving the vertically telescoping elements in two horizontal essentially perpendicular axes; and a rotating lower portion of the telescoping elements capable of rotating about an essentially vertical axis and supporting a fuel nozzle.

2. The refuelling system of claim 1 wherein the overhead gantry comprises a longitudinal axis and an axis essentially perpendicular to the longitudinal axis, and a set of rails along the longitudinal axis on which a crossmember rides.

3. The refuelling system of claim 2 further comprising a longitudinal flexible track along the longitudinal axis wherein the longitudinal flexible track supports a flexible conduit for supply of fuel.

4. The refuelling system of claim 3 further comprising a flexible track within the crossmember wherein the flexible track within the crossmember supports a flexible conduit for supply of fuel, compressed air, vapor recovery, electrical power and control signals.

5. The refuelling system of claim 4 wherein the crossmember and the longitudinal flexible track support conduits for power and control signals.

6. The refuelling system of claim 1 wherein the rotating lower of the telescoping elements rotate about at least a 180° arc.

7. The refuelling system of claim 1 wherein the plurality of vertically telescoping elements comprise a fixed upper segment and a movable segment that is attached to a movable pulley effective to guide at least one flexible conduit from a lower portion of the fixed upper segment to above the movable segment and down the inside of the movable segment.

8. The refuelling system of claim 7 further comprising a lower movable telescoping segment suspended from the movable segment, the at least one flexible conduit passing through the inside of the lower movable telescoping segment.

9. The refuelling system of claim 8 wherein the position of the movable segment is controlled by a threaded shaft that is rotatable and threadably connected to a ball nut fixed to the movable segment.

10. The refuelling system of claim 8 wherein the position of the lower movable telescoping segment is controlled by a rigid chain attached to a lower portion of the fixed upper segment, extending to an upper portion of the movable segment, and passing down through the movable segment and attached to the lower movable segment wherein the rigid chain if forced to turn essentially 180° at the upper portion of the middle segment.

11. The refuelling system of claim 10 wherein the overhead gantry comprises a longitudinal axis and an axis essentially perpendicular to the longitudinal axis, and a set of rails along the longitudinal axis on which a crossmember rides.

12. The refuelling system of claim 11 further comprising a longitudinal flexible track along the longitudinal axis wherein the longitudinal flexible track supports a flexible conduit for supply of fuel.

13. The refuelling system of claim 12 further comprising a flexible track within the crossmember wherein the flexible track within the crossmember supports a flexible conduit for supply of fuel.

14. The refuelling system of claim 13 wherein the crossmember and the longitudinal flexible track support conduits for power and control signals.

15. The refuelling system of claim 14 wherein the rotating lower portion of the telescoping elements contain a purged section and a nonpurged segment.

16. The refuelling system of claim 1 wherein the rotating lower portion of the telescoping elements contain a purged section and a nonpurged segment.

17. The refuelling system of claim 16 wherein the purged section contains any electrical relays and valves required for operation of a refueling nozzle.

18. The refuelling system of claim 1 further comprising a bracket for support of a refuelling end effector wherein the bracket is rotatable about a horizontal axis.

19. The refuelling system of claim 1 further comprising a means effective to move the fuel nozzle to varying pitches.

* * * * *